US008164542B2

(12) United States Patent
Chantalat et al.

(10) Patent No.: US 8,164,542 B2
(45) Date of Patent: Apr. 24, 2012

(54) ANTENNA USING A PBG (PHOTONIC BAND GAP) MATERIAL, AND SYSTEM AND METHOD USING THIS ANTENNA

(75) Inventors: Régis Chantalat, Limoges (FR); Patrick Dumon, Vigoulet-Auzil (FR); Bernard Jecko, Rilhac Rancon (FR); Thierry Monediere, Limoges (FR); Marc Thevenot, Rilhac Rancon (FR)

(73) Assignees: Centre National d'Etudes Spatiales, Paris (FR); Centre National de la Recherche Scientifique (C.N.R.S.), Paris (FR)

( * ) Notice: Subject to any disclaimer, the term of this patent is extended or adjusted under 35 U.S.C. 154(b) by 336 days.

(21) Appl. No.: 12/442,612

(22) PCT Filed: Sep. 24, 2007

(86) PCT No.: PCT/FR2007/001555

§ 371 (c)(1), (2), (4) Date: May 1, 2009

(87) PCT Pub. No.: WO2008/037887

PCT Pub. Date: Apr. 3, 2008

(65) Prior Publication Data

US 2010/0026606 A1 Feb. 4, 2010

(30) Foreign Application Priority Data

Sep. 25, 2006 (FR) ..... 06 08381

(51) Int. Cl.
*H01Q 15/02* (2006.01)

(52) U.S. Cl. ..... 343/909; 343/772; 343/786

(58) Field of Classification Search ..... 343/909, 343/700 MS, 753, 756, 797, 772, 786
See application file for complete search history.

(56) References Cited

U.S. PATENT DOCUMENTS

| | | | | |
|---|---|---|---|---|
| 6,549,172 | B1 * | 4/2003 | Thevenot et al. | 343/756 |
| 6,927,729 | B2 | 8/2005 | Legay | |
| 6,975,269 | B2 * | 12/2005 | Jecko et al. | 343/700 MS |
| 7,242,368 | B2 * | 7/2007 | Thevenot et al. | 343/909 |
| 7,411,564 | B2 * | 8/2008 | Thevenot et al. | 343/909 |
| 7,522,105 | B1 * | 4/2009 | LaComb | 343/700 MS |

FOREIGN PATENT DOCUMENTS

| | | |
|---|---|---|
| EP | 1 387 437 | 2/2004 |
| FR | 2 854 738 | 11/2004 |
| WO | 94/13029 | 6/1994 |
| WO | 01/37373 | 5/2001 |
| WO | 2004/040696 | 5/2004 |

OTHER PUBLICATIONS

Constatine A. Balanis, "antenna theory, analysis and design", 1982, pp. 535, 568-569, 575, 578, Harper and Row, New York.

(Continued)

*Primary Examiner* — Hoang V Nguyen
(74) *Attorney, Agent, or Firm* — Young & Thompson

(57) ABSTRACT

An antenna uses a photonic forbidden band (PFB) material in which, by default, a surface (26) for injecting and/or receiving electromagnetic waves in a resonance cavity of the antenna (8) has at least a width or a length of a diameter higher than or equal to the wavelength of the working frequency.

11 Claims, 11 Drawing Sheets

OTHER PUBLICATIONS

Figure 1:
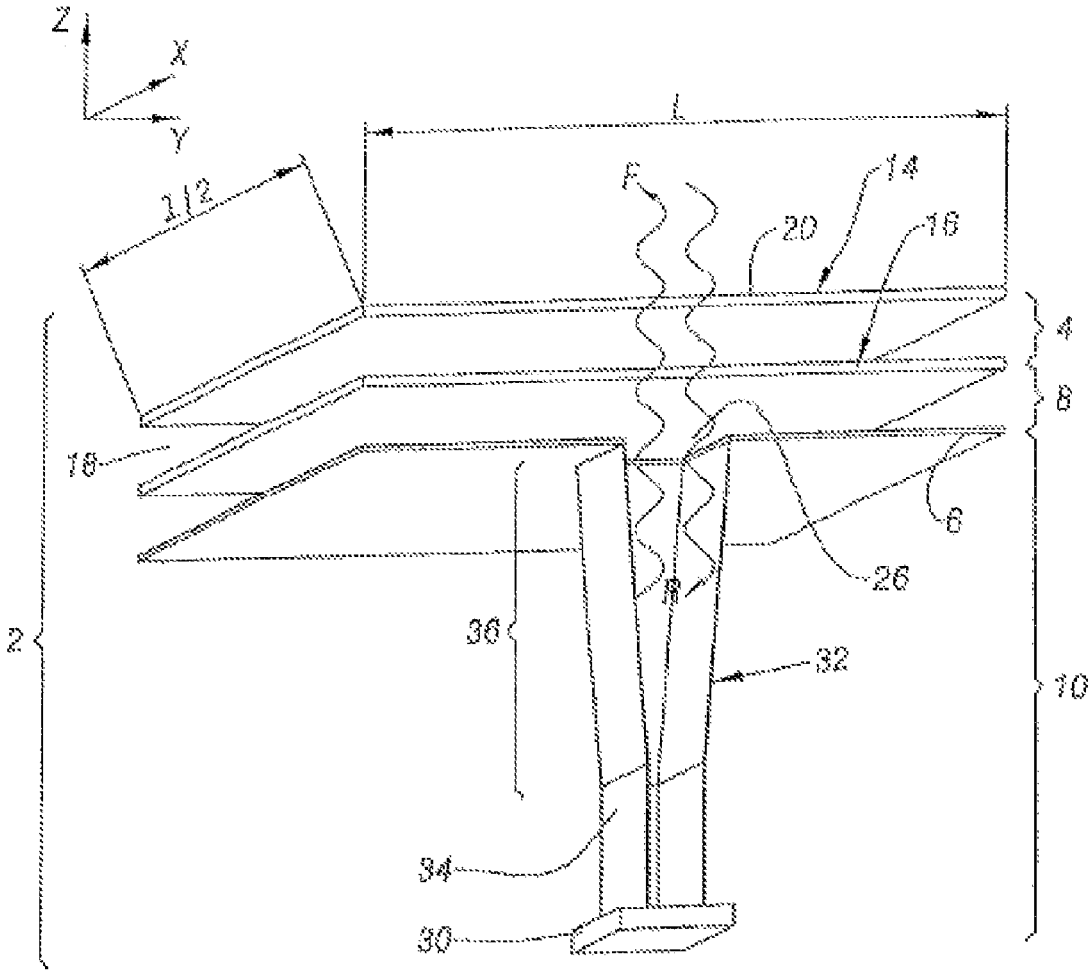

E. R. Brown et al., "Radiation properties of a planar antenna on a photonic-crystal substrate", Journal of the Optical Society of America-B, Feb. 1993, pp. 404-407, vol. 10, No. 2, Optical Society of America, Washington, DC, USA.

Marc Thevenot et al., "Directive Photonic-Bandgap Antennas", IEEE Transactions on Microwave Theory and Techniques, Nov. 1999, pp. 2115-2122, vol. 47, No. 11, IEEE Service Center, Piscataway, New Jersey, USA.

* cited by examiner

ANTENNA USING A PBG (PHOTONIC BAND GAP) MATERIAL, AND SYSTEM AND METHOD USING THIS ANTENNA

The present invention relates to an antenna using PBG (photonic band gap) material, and to a system and method using this antenna.

There exist antennas using PBG material with a defect, comprising:

- a first PBG material having at least one-dimensional periodicity and an outer face which is radiant in transmission and/or in reception,
- at least one periodicity defect of the PBG material forming a first resonant cavity capable of creating at least one narrow pass-band within a stop band of the PBG material, the cavity having an upper wall formed by a lower face of the PBG material opposite the radiating outer face, and a lower wall facing the upper wall, and
- at least one excitation device capable of making the resonant cavity resonate, the device having a surface for injecting and/or receiving electromagnetic waves at a working frequency contained within the narrow pass-band, the surface being flush with the lower wall of the cavity.

These existing antennas have been described, for example, in the patent application filed under number FR 99 14 521 by C.N.R.S. (Centre National de la Recherche Scientifique).

In the existing antennas, the excitation device is typically a patch antenna, a dipole, a probe antenna or a wire-patch antenna.

Such antennas using PBG material with a defect have a high gain and a high directivity. However, for some applications, it is necessary to increase the directivity of such antennas still further.

The invention aims to satisfy this wish by proposing an antenna which, while using identical PBG material with a defect, has increased directivity as compared with the known antennas.

The invention accordingly relates to an antenna using PBG material, in which the injection and/or reception surface has at least a width or a length or a diameter greater than $\lambda$, where $\lambda$ is the wavelength of the working frequency.

It has been found that the fact of using an excitation device whose injection and/or reception surface has a dimension (that is to say here a width or a length or a diameter) greater than the wavelength $\lambda$ increases the directivity of antennas using PBG material.

More precisely, flush here denotes a surface that is substantially in the plane defined by the reflector plane 6. Accordingly, the surface for injecting and/or receiving electromagnetic waves can be at a very small distance h above or below the reflector plane 6. Typically, the distance h, measured according to a direction z perpendicular to the reflector plane, is considered to be very small when it is from $-\lambda/10$ to $+\lambda/20$, $-\lambda/10$ corresponds to the maximum distance below the reflector plane and $+\lambda/20$ corresponds to the maximum distance above the reflector plane (that is to say on the cavity side).

The embodiments of this antenna can have one or more of the following features:

- the distribution of the power of the electromagnetic waves over the injection and/or reception surface has a point where the power is maximum, that point being remote from the periphery of that surface, and the power decreases continuously along a straight line running from that point to the periphery, irrespective of the direction of the straight line considered in the plane of the surface;

- the excitation device comprises at least one flared electromagnetic waveguide equipped with a distal end, which opens inside the resonant cavity, and a proximal end capable of being connected to an electromagnetic wave generator and/or receiver, the surface area of the transverse cross-section of the distal end being strictly greater than the surface area of the transverse cross-section of the proximal end, and in which the distal end of the waveguide is flush with the lower wall in order to form said injection and/or reception surface;
- the flared guide comprises a feed guide, the transverse cross-section of which is constant and equal to the cross-section of the proximal end, and a flared portion, the transverse cross-section of which increases from a small cross-section identical with the transverse cross-section of the proximal end to a large cross-section identical with the transverse cross-section of the distal end, the small cross-section of the flared portion being placed end-to-end with the feed guide, and in which the dimensions of the transverse cross-section of the feed guide are suitable for permitting only one propagation mode of the electromagnetic waves inside the feed guide;
- the dimensions of the transverse cross-section of the feed guide are suitable for permitting only propagation mode TE10 or TE11;
- the shortest distance separating the small cross-section of the flared portion from the large cross-section is greater than $d_{min}$, where $d_{min}=0.25*a$; and a is equal to the largest width or length or diameter of the large cross-section;
- the excitation device is itself a structure using PBG material with a defect, comprising a second PBG material (114) having at least one-dimensional periodicity and an outer face flush with the lower wall of the resonant cavity in order to form said injection and/or reception surface of the excitation device;
- the excitation device is a waveguide comprising a plurality of lateral walls which guide the electromagnetic waves in a direction parallel to the lower wall of the cavity, one of those walls being permeable to the guided electromagnetic waves and flush with the lower wall of the cavity in order to form said injection and/or reception surface;
- the excitation device comprises an earth plane and a strip of conductive material fixed to the surface of the earth plane and electrically insulated from the earth plane, the strip being fitted flush on the lower wall of the cavity in order to form said injection and/or reception surface when it is connected to an electromagnetic wave generator and/or receiver;
- the injection and/or reception surface is strictly less than the surface area of the radiating outer face, and is preferably less than twice the surface area of the radiating outer face;
- the lower wall of the cavity and the injection and/or reception surface are in the same plane;
- the antenna comprises a plurality of excitation devices each having an electromagnetic wave injection and/or reception surface flush with the lower wall of the cavity.

The embodiments of the antenna further have the following advantages:

- because the distribution of the power of the electronic waves has a maximum and decreases towards the periphery of the injection and/or reception surface, it is possible, with an identical PBG material, to increase the directivity while retaining the same radiation pass-band as that of the known antennas, the use of a flared waveguide as the excitation device further allows the gain of the antenna to be increased, the use of a feed guide allows the most appropriate electromagnetic wave propagation mode for operation of the antenna to be selected, the use of propagation modes TE10 or TE11 optimises the operation of the antenna, a distance greater than $d_{min}$ makes it possible to have good phase uniformity of the electromagnetic waves in the region of the injection and/or reception surface, which improves the performance of the antenna, the use of a structure using PBG material as the excitation device allows the space requirement of the antenna to be reduced as compared with the use of a flared waveguide while its performance remains the same, the use of a waveguide in which one of the lateral walls is permeable to the guided electromagnetic waves makes it possible to reduce the space requirement of the antenna as compared with an antenna in which the excitation device is a flared waveguide, the use of a strip of conductive material to form the injection and/or reception surface makes it possible to reduce the dimensions of the antenna using PBG material as compared with the case in which the excitation device is a flared waveguide.

The invention relates also to a system for transmitting and/or receiving electromagnetic waves, comprising:

a device for focusing the electromagnetic waves transmitted and/or received by the system, which device has a focus, and a multi-bundle antenna comprising an outer face which is radiant in transmission or in reception and is located substantially at the level of the focus of the focusing device, and in which the multi-bundle antenna is an antenna using PBG (photonic band gap) material, comprising:

a first PBG material having at least one-dimensional periodicity and an outer face which is radiant in transmission and/or in reception, at least one first periodicity defect of the PBG material forming a first resonant cavity capable of creating at least one narrow pass-band within a stop band of the PBG material, the cavity having an upper wall formed by a lower face of the PBG material opposite the radiating outer face, and a lower wall facing the upper wall, a plurality of excitation devices capable of making the resonant cavity resonate, the devices having a surface for injecting and/or receiving electromagnetic waves at a working frequency contained within the narrow pass-band, the surface being flush with the lower wall of the cavity.

Each injection and/or reception surface has at least a width or a length or a diameter greater than λ, where λ is the wavelength of the working frequency of the corresponding excitation device.

The invention relates also to a method for transmitting and/or receiving electromagnetic waves with the aid of the above antenna using PBG material.

Figure 2:
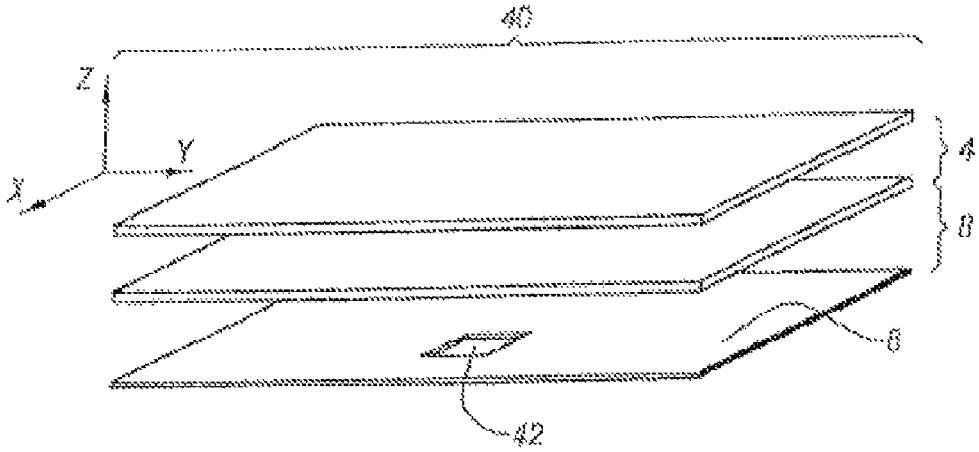
Figure 3:
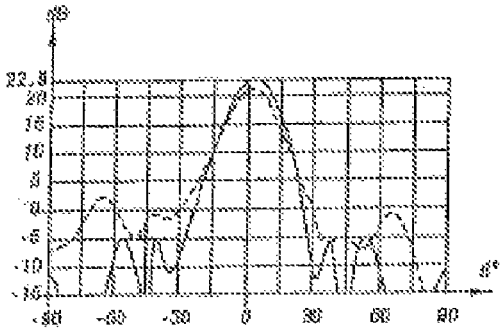
Figure 4:
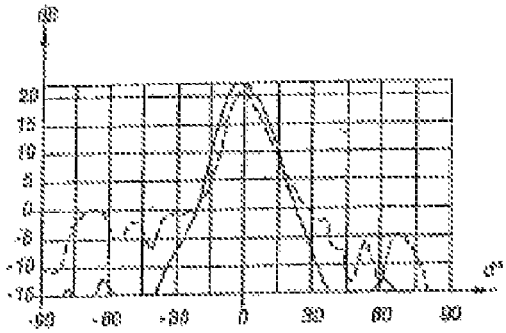
Figure 5:
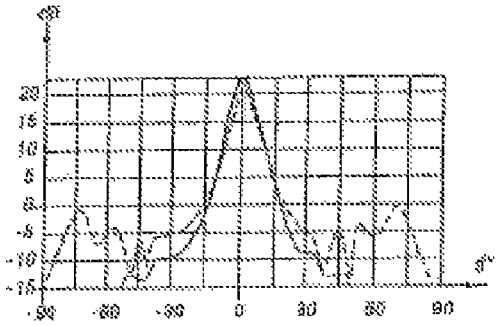
Figure 6:
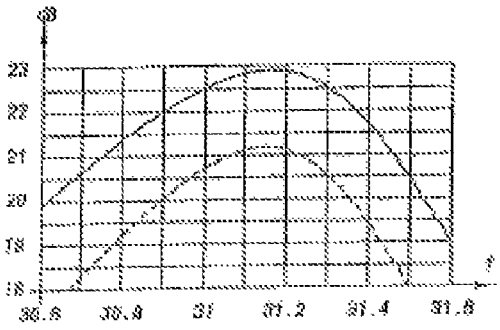
Figure 7:
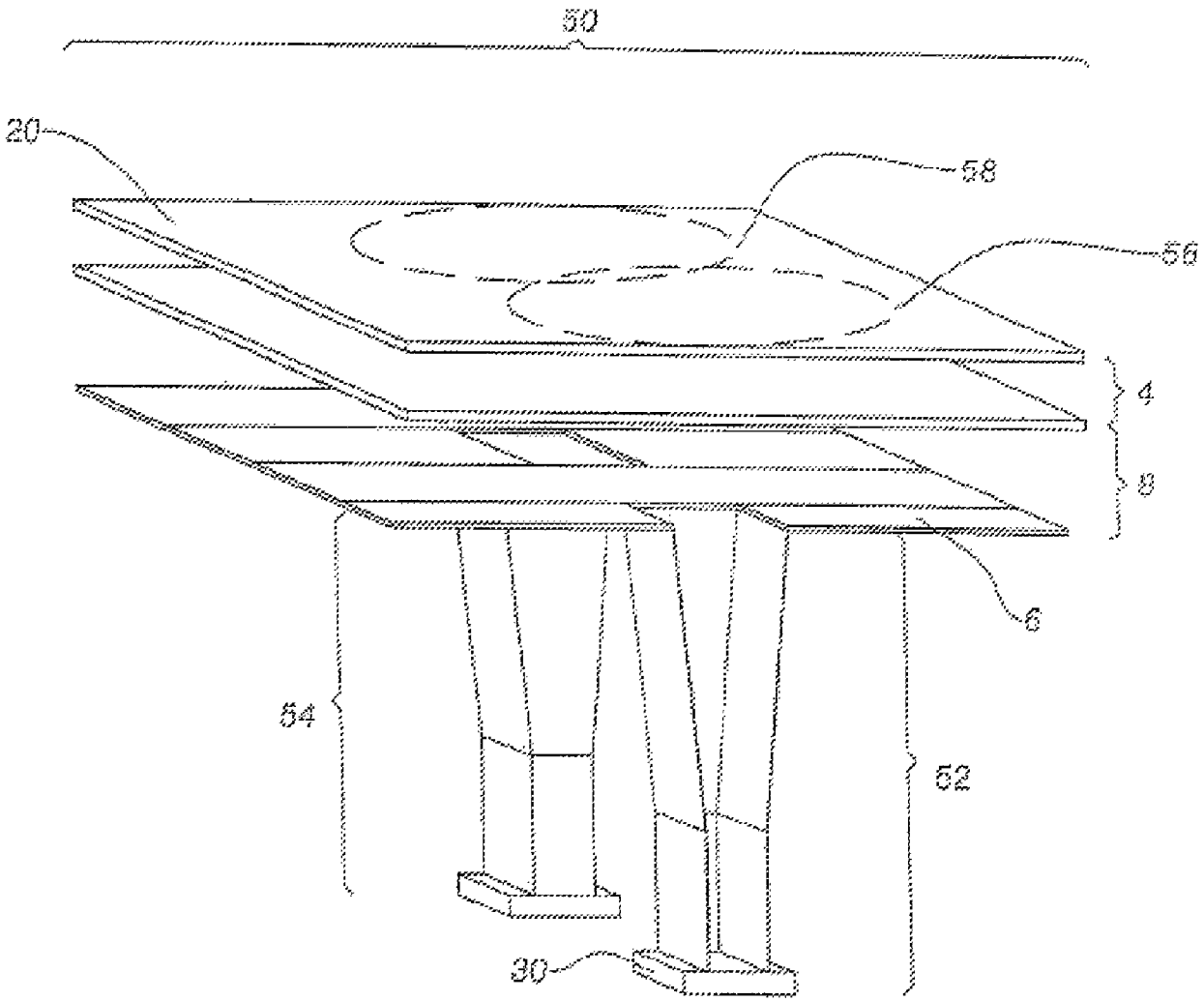
Figure 8:
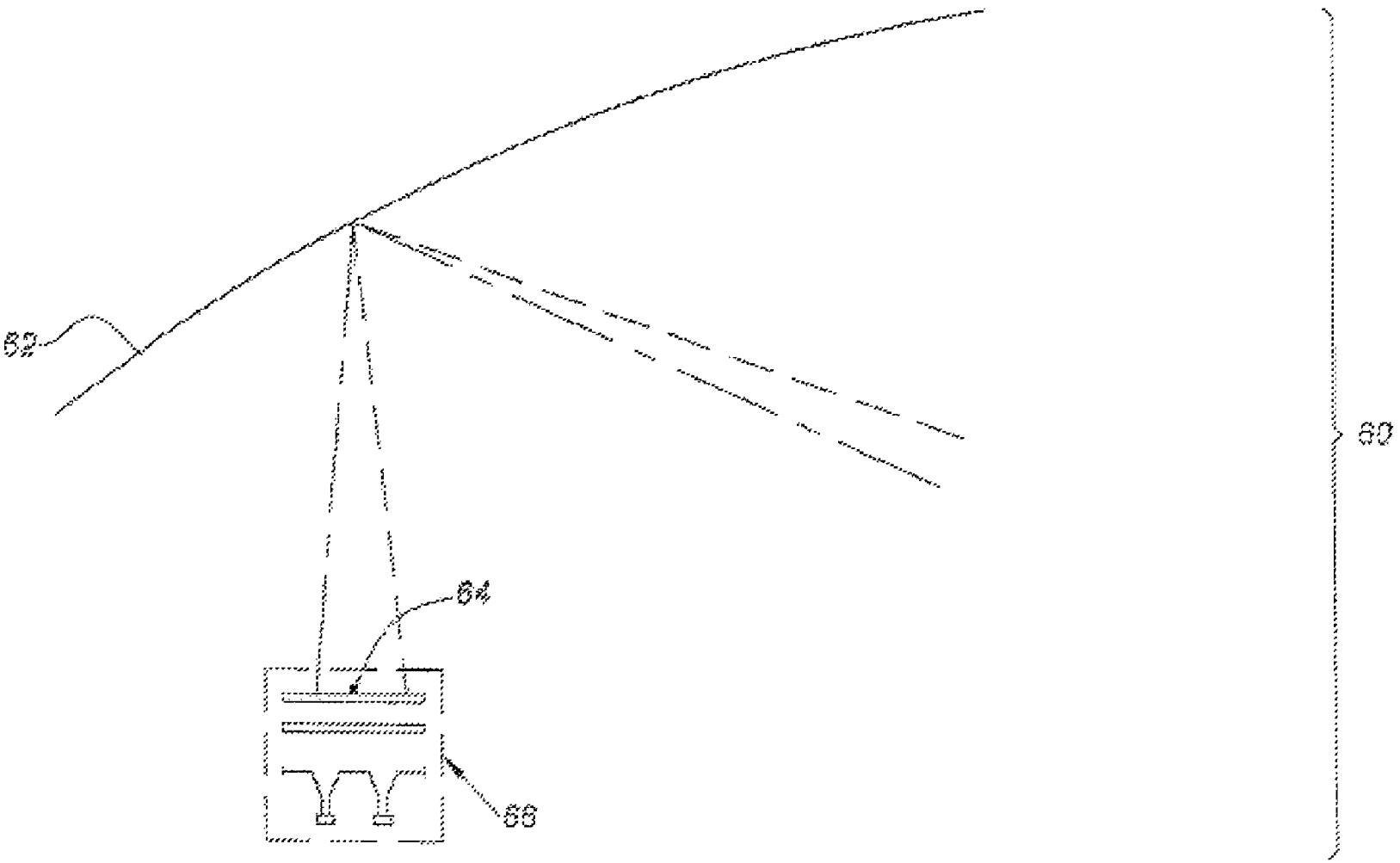
Figure 12:
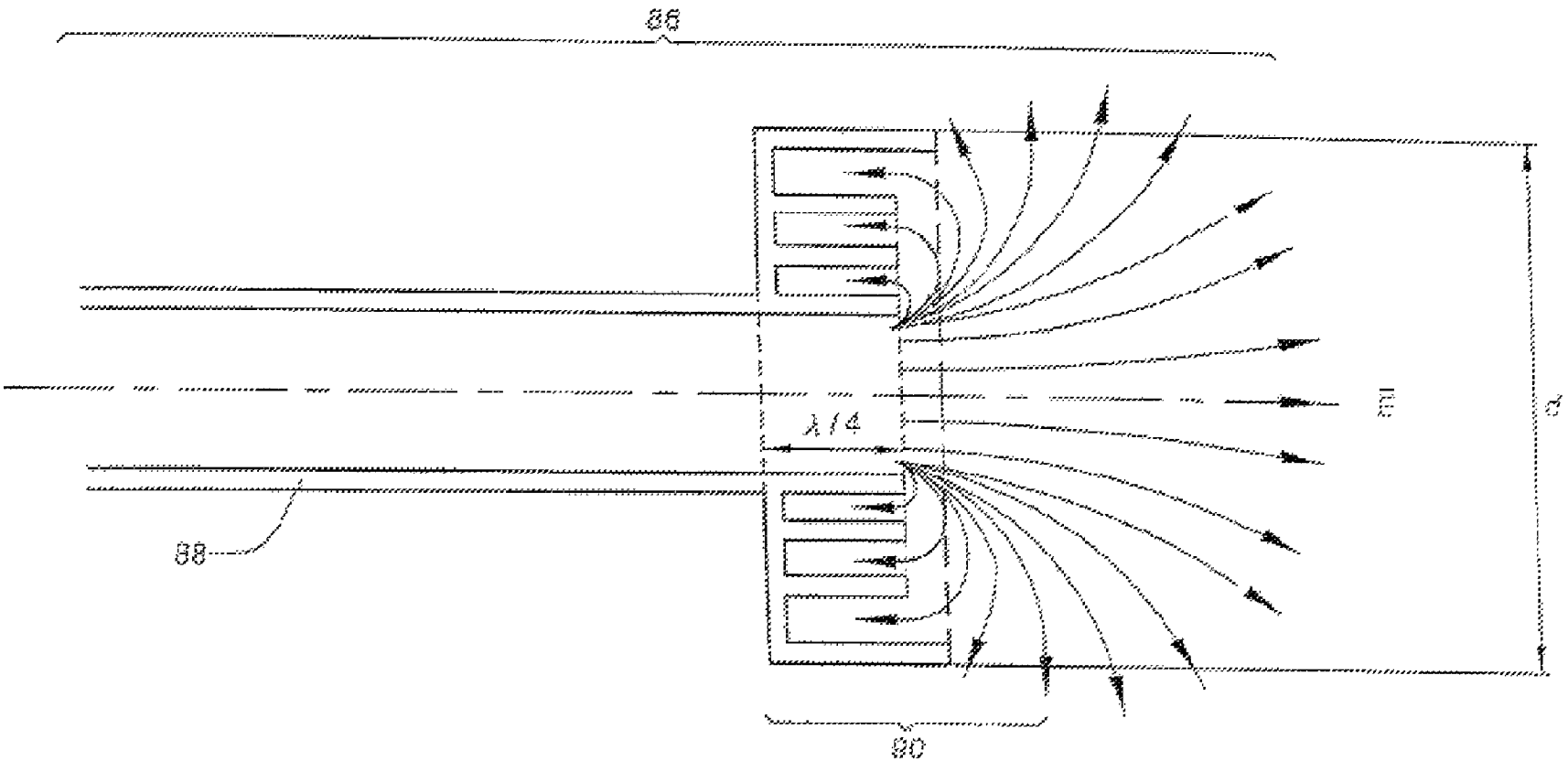
Figure 13B:
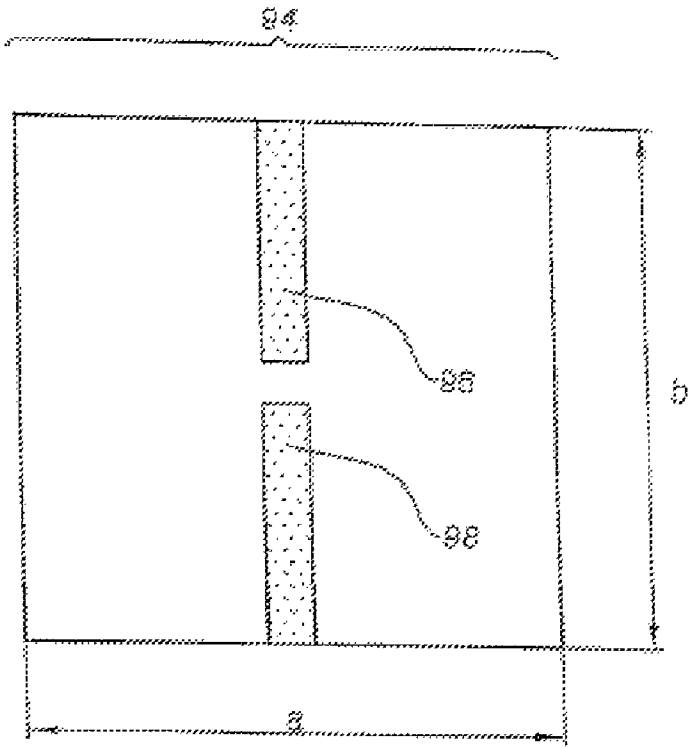
Figure 13A:
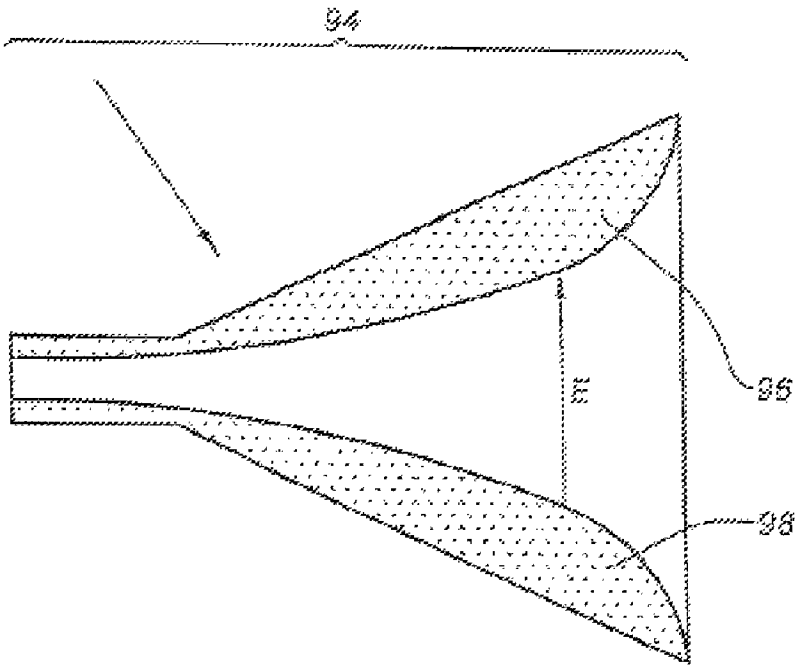
Figure 14:
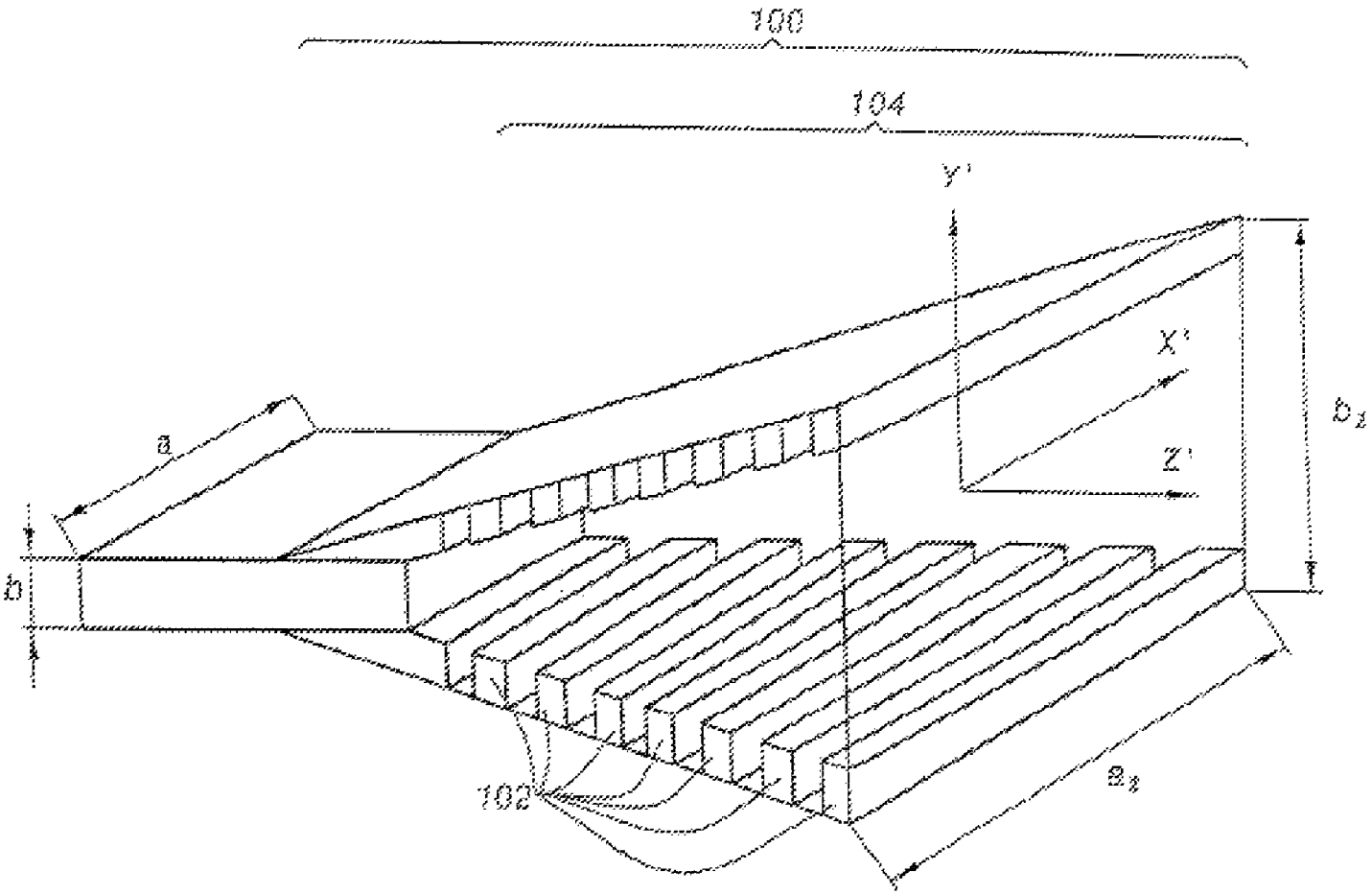

The invention will be better understood from reading the following description, which is given solely by way of non-limiting example and with reference to the drawings, in which:

FIG. 1 is a perspective cutaway view of a diagrammatic illustration of the architecture of an antenna using PBG material with a defect, FIG. 2 is a perspective view of a known antenna using PBG material with a defect, FIGS. 3 to 5 are illustrations of the radiation diagrams obtained with the aid of the antennas of FIGS. 1 and 2, FIG. 6 is a graph showing the zenithal directivity of the antennas of FIGS. 1 and 2 as a function of their respective working frequencies, FIG. 7 is a perspective cutaway view of a second embodiment of a multi-source antenna using PBG material with a defect, FIG. 8 is a diagrammatic illustration of an electromagnetic wave transmission/reception system equipped with a focusing device, FIGS. 9 to 12 are diagrammatic illustrations of different structures of flared waveguides which can be used in the antenna of FIG. 1 or 7, FIGS. 13A and 13B are front and side views, respectively, of a ridge waveguide (or ridge horn antenna), FIG. 14 is a diagrammatic illustration of a corrugated waveguide which can be used in the antenna of FIG. 1 or 7, and FIGS. 15 to 17 are diagrammatic illustrations of three other embodiments of antennas using PBG material.

FIG. 1 shows an antenna 2 using PBG material which is designed to operate at a working frequency of 31.2 GHz. The antenna 2 comprises:

a PBG material 4, a plane 6 that reflects electromagnetic waves, a resonant cavity 8 formed between the PBG material 4 and the plane 6, a device 10 for excitation of the resonant cavity 8.

For example, the PBG material 4, the cavity 8 and the plane 6 are produced in accordance with the teaching of the patent application published under number WO 1137373 by C.N.R.S. (Centre National de la Recherche Scientifique) on 18 Nov. 1999.

By way of illustration, the material 4 is here produced by stacking, in a vertical direction z, planar layers of different permittivity. Each of the layers extends in a horizontal plane defined by orthogonal directions x and y relative to the direction z.

More precisely, the antenna 2 comprises two planar layers 14 and 16 produced from a material whose relative permittivity $\epsilon_r$ is 5.4 and a layer of air 18 inter-posed between the two layers 14 and 16. The layer of air has a thickness of, for example, 2.3 millimeters in the direction z.

Here, each of the layers is rectangular and has a length l of 161 millimeters and a width L of 100 millimeters.

The layer 14 is disposed at the top of the stack and therefore has a radiating outer face 20 parallel to the directions x and y.

The cavity 8 has an upper wall formed by the lower face of the layer 16, and a lower wall formed by the upper face of the reflector plane 6. The cavity is filled with air and has a height in the direction z of 4.75 millimeters.

The plane 6 extends parallel to directions x and y. For example, the dimensions of the plane 6 in directions x and y are the same as those of the layers 14 and 16. The plane 6 is impermeable to electromagnetic waves. For example, the plane 6 is made of a conductive material such as a metal.

An opening 26 is formed substantially in the middle of the plane 6. The opening 26 here has a square cross-section of 14.4 millimeters by 14.4 millimeters.

The device 10 comprises an electromagnetic wave generator/receiver 30 and a flared waveguide 32 capable of guiding the waves generated by the generator 30 towards the cavity 8 and of guiding the waves received by way of the surface 20 to the generator/receiver 30. In FIG. 1, the propagation direction of the transmitted electromagnetic waves is represented by a wavy upward arrow F parallel to the direction z. Conversely, the propagation direction of the received electromagnetic waves is represented by a wavy downward arrow R parallel to the direction z.

The waveguide 32 is here a pyramidal horn formed by a feed guide 34 placed end-to-end with a flared portion 36.

The feed guide 34 has a constant rectangular transverse cross-section. Here, the expression transverse cross-section denotes a cross-section in a plane perpendicular to the propagation direction of the electromagnetic waves. The dimensions of the transverse cross-section are chosen to permit propagation of the electromagnetic waves only according to mode TE10. Here, for example, for the working frequency of 31.2 GHz, the transverse cross-section of the feed guide 34 has a width and a length of 4.3 mm and 8.6 mm, respectively.

A proximal end of the guide 34 is connected directly to the generator/receiver 30, while an opposite end is directly joined end-to-end to the flared portion 36.

The section 36 has an end which is joined end-to-end to the end of the guide 34. The end-to-end joined end has a rectangular cross-section of 8.6 by 4.3 mm. The waveguide also has a distal end which opens inside the cavity 8. More precisely, the distal end of the flared portion 36 opens in the opening 26. The distal end and the opening 26 have the same dimensions. Accordingly, the distal end is here produced in the same plane as that defined by the reflector plane 6.

The width and the length of the transverse cross-section of the flared portion 36 increase gradually between the end-to-end joined end and the distal end of the flared portion 36.

Typically, the distance d according to direction z between the end-to-end joined end and the distal end of the flared portion 36 is greater than 0.25a and is preferably greater than $a^2/2$, where a is the largest width of the distal end expressed in μm. Here, the distance d is from $0.5 \times l_c$ to $6 \times L_c$, where $l_c$ and $L_c$ are the width and the length, respectively, of the transverse cross-section of the distal end of the flared portion 36. Here, $l_c$ and $L_c$ are equal because the transverse cross-section is square.

For example, the distance d is here chosen to be 19.4 millimeters.

The distal end of the flared section 36 forms a surface for injecting and receiving electromagnetic waves inside the cavity 8. That surface is here perpendicular to the propagation directions F and R. The surface here has the same dimensions as those of the opening 26. In particular, because the working frequency of the antenna 2 is 31.2 GHz, it will be noted that the width and the length of the surface are equal to 1.5λ, where λ is the wavelength of the working frequency. Under those conditions, the directivity of the antenna 2 is better than that of the existing antennas using PBG material with a defect, while the same radiation pass-band is retained, as will be shown by means of FIGS. 3 to 6.

FIG. 2 shows an existing antenna 40 using PBG material produced in accordance with the teaching of the patent application filed under number FR 99 14 521. More precisely, the antenna 40 differs from the antenna 2 only in that it is excited by a patch probe 42 instead of being excited by the device 10. The patch probe 42 has a width and a length of 2.9 millimeters and 4.3 millimeters, respectively, capable of injecting into the cavity 8 electromagnetic waves at the working frequency of 31.2 GHz. The dimensions of the patch probe 42 are determined by its working frequency and are therefore necessarily less than the wavelength λ. More precisely, the length of the patch probe 42 is equal to λ/2.

FIGS. 3 to 5 show the radiation diagrams of the antennas 2 and 40, respectively, in the plane E, in the plane at 45° and in the plane H.

In those graphs, the X-axis represents the angle of the measuring direction relative to the zenithal direction of the antenna. The Y-axis represents the directivity expressed in decibels. On the graphs of FIGS. 3 to 5, the dotted line represents the radiation diagram of the antenna 40, while the continuous line represents the radiation diagram of the antenna 2.

As will be noted, the maximum directivity of the antenna 2 occurs according to the zenithal direction. The maximum directivity of the antenna 2 is greater than that of the antenna 40 by 1.7 decibels. The maximum directivity of the antenna is here substantially equal to 22.9 decibels.

Moreover, the secondary lobes of the antenna 2 are clearly below those of the antenna 40, irrespective of the plane taken into account for measuring the radiation diagram. This is an additional advantage of the antenna 2 over the antenna 40.

The graph of FIG. 6 shows the maximum directivity (at the zenith) of the antennas 2 and 40 according to the zenithal direction for different working frequencies f. The Y-axis represents the power in decibels, while the X-axis represents the working frequency.

In FIG. 6, the dotted line and the continuous line represent the measurements obtained for the antenna 40 and the antenna 2, respectively.

The graph of FIG. 6 shows that, with an identical pass-band at −3 dB, the antenna 2 has a maximum directivity which is almost twice the directivity of the antenna 40. Accordingly, the use of an excitation device having an injection and/or reception surface of which at least the width, the length or a diameter is greater than the wavelength λ allows the pass-band of the antenna to be increased, with identical maximum directivity. In fact, such an excitation device makes it possible to obtain the same directivity as a conventional antenna using PBG material but using a less selective PBG material.

FIG. 7 shows another embodiment of an antenna 50 using PBG material with a defect. For example, the antenna 50 is identical to the antenna 2 except that it comprises a plurality of devices for excitation of the cavity 8. In order to simplify FIG. 7, only two excitation devices 52 and 54 have been shown.

For example, the device 52 is identical with the device 10 of antenna 2.

The device 54 is also identical with the device 10, except that the generator/receiver 30 is suitable for receiving and transmitting at a working frequency that is slightly different from that used by the device 52.

Accordingly, the antenna 50 is a multi-bundle antenna. The devices 52 and 54 are preferably arranged relative to one another in accordance with the teaching of the patent application published under number WO 2004/040696 in order to form on the face 20 partially overlapping radiating spots 56 and 58.

FIG. 8 shows a system 60 for transmitting and receiving electromagnetic waves. The system 60 comprises a device 62 for focusing the electromagnetic waves towards a focus 64. For example, the device 62 is a parabolic or concave electromagnetic wave reflector. The device 62 can also be a lens suitable for focusing the received electromagnetic waves on the focus 64.

The system 60 also comprises a multi-bundle antenna 66, the radiating face of which is located at the level of the focus 64. Here, the antenna 66 is, for example, identical with the antenna 50.

FIGS. 9 to 14 show different types of waveguides which can be used instead of the waveguide 32 described in connection with FIG. 1.

Figure 9:
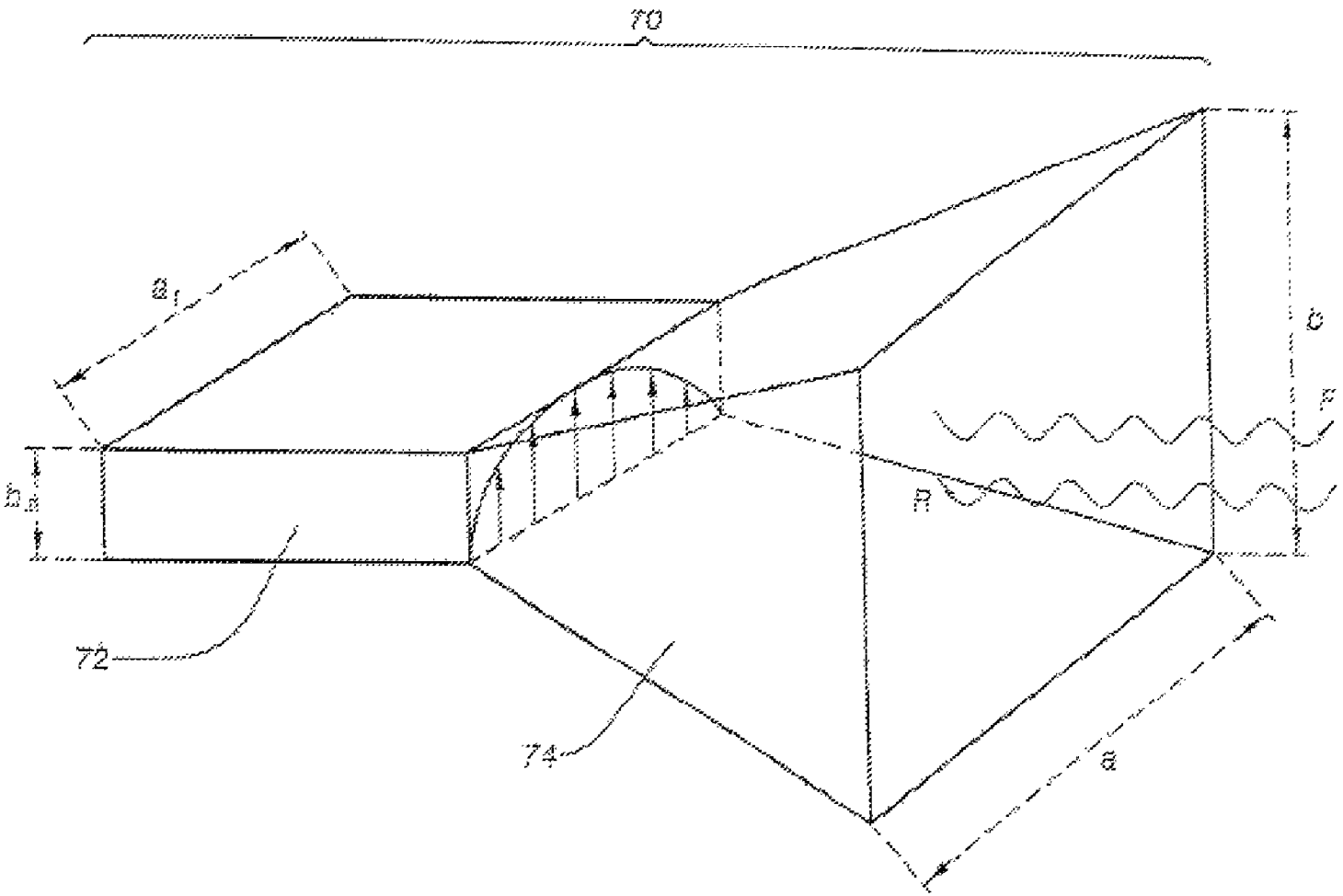

More precisely, FIG. 9 shows a waveguide 70 which is better known by the name pyramidal horn.

In FIG. 9, the propagation and reception directions are represented by wavy arrows F and R, respectively.

As with the waveguide 32, the waveguide 70 comprises a feed guide 72 placed end-to-end with a flared portion 74.

The transverse cross-section of the feed guide 72 is rectangular and constant. The length and width of that cross-section are designated $a_1$ and $b_1$ in FIG. 9.

The transverse cross-section of the flared portion 74 increases gradually from a transverse cross-section that is equal to that of the feed guide 72 to a wider distal transverse cross-section. The length and width of this distal transverse cross-section are designated a and b in FIG. 9. For its use in the antenna 2, at least one of the width a or the length b must be greater than the working wavelength λ.

Further information on pyramidal horns will be found in the following biographical reference:

"Some data for the design of electromagnetic horns", E. H. BRAUN, IRE Trans. Antennas and Propag., Vol. AP 4, No. 1, pp. 29-31, January 1956.

Figure 10:
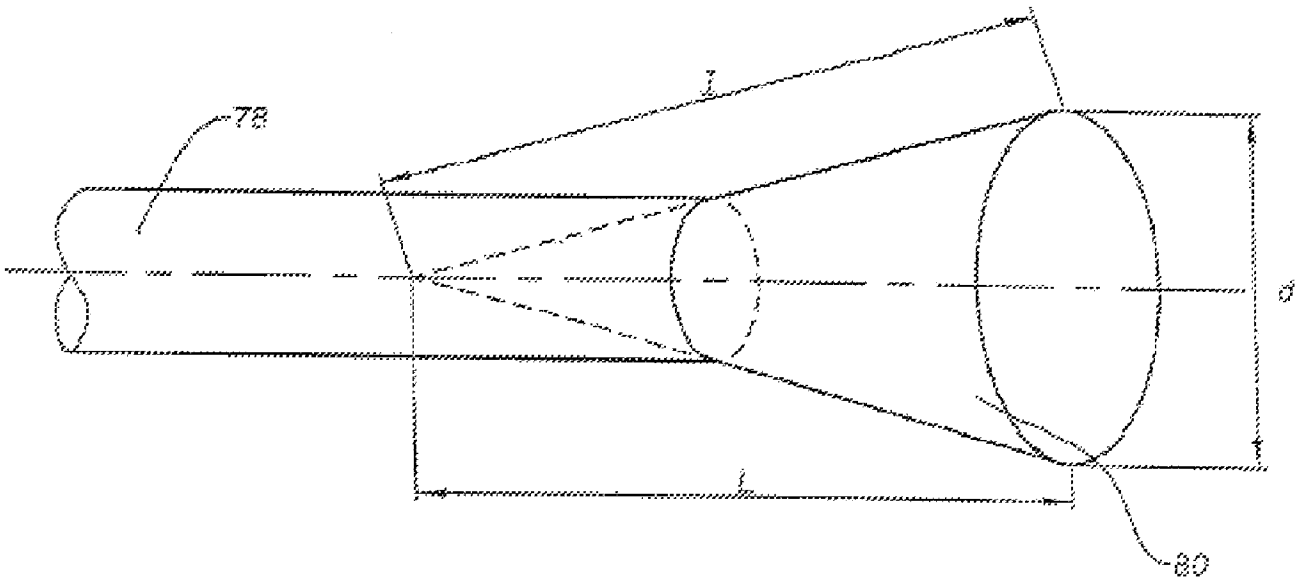

FIG. 10 shows a different type of waveguide known by the name conical horn.

The conical horn has a feed guide 78 connected to a flared portion 80. The transverse cross-sections of both the feed guide 78 and the flared portion 80 are circular. The dimensions of the transverse cross-section of the guide 70 are determined so as to permit only propagation mode TE11 of the electromagnetic waves.

For its use in the antenna 2, the largest width of the distal transverse cross-section of the portion 80, that is to say here the diameter d, must be greater than the working wavelength λ.

Figure 11:
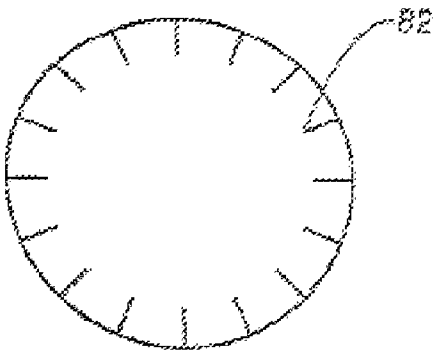

The inside of the flared portion 80 can be smooth or it can comprise vanes 82 as shown in FIG. 11. The vanes 82 force the electromagnetic field to be cancelled perpendicularly to the wall.

More information on conical horns can be found in the following article:

"Electromagnetic field of a conical horns" M. G. SCHORR and F. J. BECK, IRE Trans. Antenna and Propag., Vol. AP 4, No. 1, pp. 29-31, January 1956.

FIG. 12 shows a different embodiment of a waveguide 86 known by the name "trap horn".

The waveguide 86 comprises a feed guide 88 and a flared portion 90. The guide 88 is a circular guide.

The portion 90 is constituted by concentric rings having a depth close to λ/4, where λ is the working wavelength. The diameter d of the largest of those concentric rings must be greater than the wavelength λ in order to be used in the antenna 2.

FIGS. 13A and 13B show a waveguide 94 known by the name "ridge horn".

The guide 94 comprises, inside its flared portion, two vanes 96, 98 which extend from the end-to-end joined end to the distal end according to a curve designed to render uniform the phase shift of the electromagnetic waves, which allows a greater bandwidth to be obtained.

The transverse cross-section of the distal end of the flared portion is, for example, square. The width of the square must be greater than the wavelength λ in order to be used in the antenna 2.

More information on this type of waveguide will be found in the following article:

"Analysis and simulation of 1 to 18 GHz broadband double ridge horns antenna", Burns C. and Leuchtmann P., IEEE Trans. On Electromagnetic compatibility, Vol. 45 4, No. 1, pp. 55-60, February 2003.

FIG. 14 shows a corrugated waveguide 100 which is also better known by the name "corrugated horn".

This type of corrugated horn comprises a plurality of ribs 102 which extend along the inner periphery of a flared portion 104 of the horn.

Such a corrugated horn is rotationally symmetrical and has a pass-band which may be greater than an octave.

As with the waveguide 70, at least one of the length $a_2$ and the width $b_2$ of the rectangular transverse cross-section of the distal end of the flared portion must be greater than the working wavelength λ in order to be used in the antenna 2. The ribs 102 of the corrugated horn allow an HE11 propagation mode of the electromagnetic waves to be generated.

More information on this type of waveguide will be found in the following articles:

"Properties of cutoff corrugated surfaces for corrugated horns design", C. A. Mentzer and L. Peters, IEEE Trans. Antennas propag., Vol. AP 22, No. 2, pp. 191-196, March 1974;

"Pattern analysis of corrugated horns antennas", C. A. Mentzer and L. Peters, IEEE Trans. Antennas propag., Vol. AP 24, No. 3, pp. 304-309, March 1976.

Figure 15:
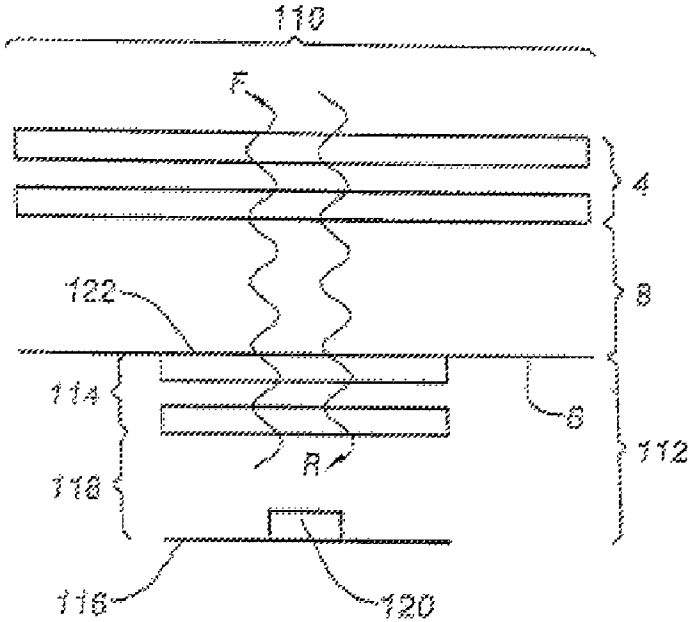

FIG. 15 shows an antenna 110 using PBG material with a defect identical to the antenna 2, except that the excitation device 10 has been replaced by a device 112 for excitation of the cavity 8.

The device 112 is itself a structure using PBG material with a defect. It comprises:

- a PBG material 114,
- a reflector plane 116,
- a resonant cavity 118, an upper wall of which is formed by a lower face of the material 114 and a lower wall of which is formed by an upper face of the plane 116, and
- a device 120 for excitation of the antenna.

The device 112 is designed in accordance with the teaching of the patent application filed under number FR 99 14 521. The excitation device 120 located inside the cavity 118 is here a patch probe, a dipole, a slot antenna or a wire-patch antenna or a flared waveguide.

The device 112 has an upper face 122. The upper face 122 is flush with the inside of the opening 26 formed in the reflector plane 6 so as to inject and receive electromagnetic waves in the cavity 8.

In FIG. 15, wavy arrows F and R represent the propagation directions of the electromagnetic waves on transmission and reception, respectively.

The face 122 is, for example, rectangular and has a length $a_3$ and a width $b_3$. Preferably, the length $a_3$ and the width $b_3$ are greater than the working wavelength λ of the antenna 110 in order to increase the directivity and the gain of the antenna while retaining the same radiation pass-band.

Here, the face 122 is located in the same plane as that of the reflector plane 6.

Figure 16:
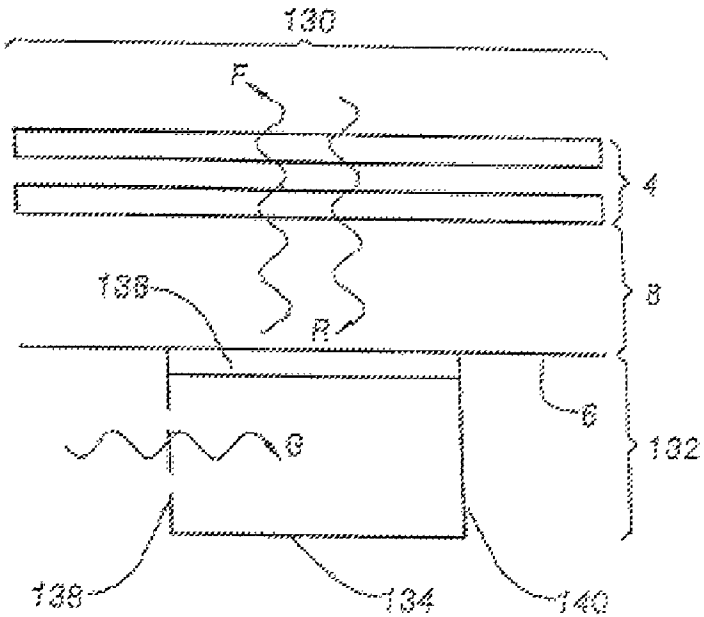

FIG. 16 shows an antenna 130 using PBG material with a defect. The antenna 130 is identical with the antenna 2 except that the excitation device has been replaced by an excitation device 132.

The device 132 is a waveguide equipped to that end with lower lateral walls 134 and upper lateral walls 136. The lateral walls 134 and 136 are parallel to the propagation direction of the guided waves and are also parallel to the reflector plane 6.

An arrow G represents the propagation direction of the electromagnetic waves inside the device 132. As in the preceding figures, wavy arrows F and R represent the propagation directions of the electromagnetic waves transmitted and received by the antenna 30.

The device 132 comprises an opening 138 by way of which the guided electromagnetic waves are received, and an end 140 perpendicular to the walls 134 and 136. The end 140 is preferably closed off by a plate which is impermeable to electromagnetic waves.

The lateral wall 136 is made of a material that is permeable to electromagnetic waves in order to allow the electromagnetic waves guided by the device 132 to escape towards the cavity 8.

Here, the wall 136 is flush with the inside of the cavity 8 in the same plane as that formed by the reflector plane 6.

With the exception of the wall 136, the other walls which are to guide the electromagnetic waves are impermeable to those electromagnetic waves in order to prevent electromagnetic waves from escaping.

Figure 17:
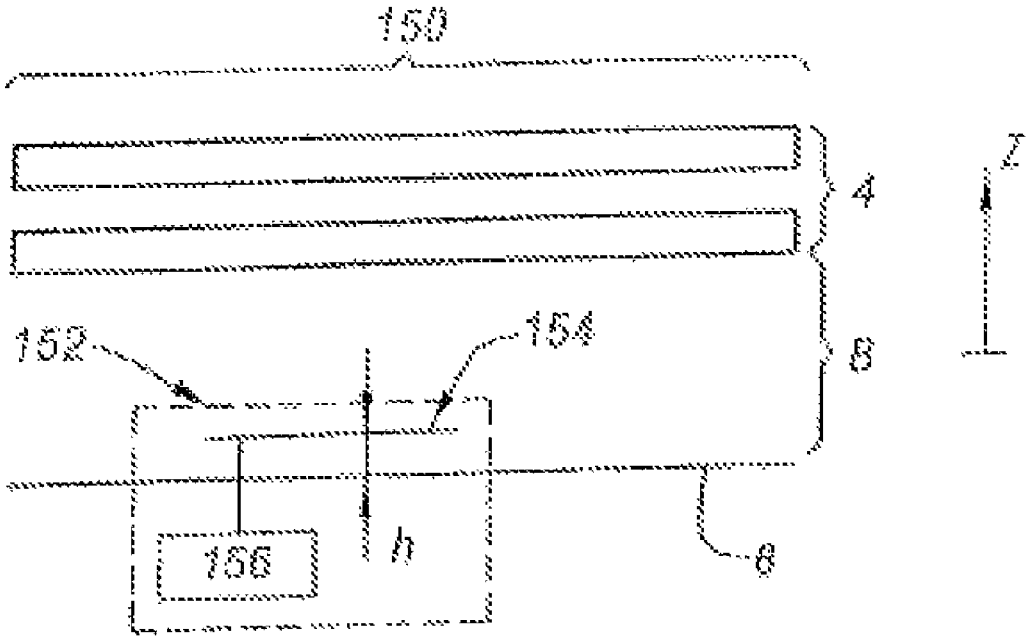

FIG. 17 shows an antenna 150 using PBG material with a defect. The antenna 150 is identical with the antenna 2 except that the excitation device has been replaced by an excitation device 152. The device 152 comprises:

the reflector plane 6, a strip 154 of conductive material extending parallel to the reflector plane 6, and an electromagnetic wave generator/receiver 156.

The strip 154 is insulated electrically from the reflector plane 6 and is connected to the generator/receiver 156. The strip has a constant width $a_4$ and a length $b_4$. The length $b_4$ is greater than the wavelength λ. The strip 154 forms the injection and reception surface for electromagnetic waves.

In the antenna 150, the reflector plane 6 is made of a conductive material. The plane 6 is also connected to a reference potential such as an earth.

The distance h between the plane 6 and the strip 152, measured according to the direction z, is here less than λ/40, so that the injection and/or reception surface is considered to be flush with the plane 6.

Numerous other embodiments are possible. For example, the antenna 2 has here been described in the particular case where the working frequency is 31.2 GHz. However, antenna using PBG material according to the teaching given here can also be designed for working frequencies between 0.5 GHz and 50 GHz.

The feed guide of the various excitation devices having flared waveguides described here can be omitted if the source 30 is suitable for directly generating only the correct electromagnetic wave propagation mode. By way of variation, if the transverse cross-section of the feed guide has a width or a length or a diameter greater than the working wavelength λ, then the flared portion can be omitted.

Numerous other types of waveguide can be used as the feed device. For example, a Potter horn can be used. For further information on this type of horn reference can be made to the following article:

"A new horn antenna with suppressed side lobes and equal beamwidths", P. D. Potter, Microwave J., Vol. 6, pp. 71-78, June 1963.

However, in all cases, the electromagnetic wave injection/reception surface flush with the reflector plane must have a dimension, that is to say here a width, a length or a diameter, that is greater than the working wavelength λ.

Preferably, the distance h between the reflector plane and the injection/reception surface is from −λ/20 to +λ/40.

The invention claimed is:

1. Antenna using PBG (photonic band gap) material with a defect, comprising:

a first PBG material (4) having at least one-dimensional periodicity and an outer face (20) that is radiant in transmission and/or in reception, at least one first periodicity defect of the PBG material forming a first resonant cavity (8) capable of creating at least one narrow passband within a stop band of the PBG material, the cavity having an upper wall formed by a lower face of the PBG material opposite the radiating outer face, and a lower wall facing the upper wall, and at least one excitation device (10; 70; 86; 94; 100; 112; 132; 152) capable of making the resonant cavity resonate, the device having a surface (26; 122) for injecting and/or receiving electromagnetic waves at a working frequency contained within the narrow passband, the surface being flush with the lower wall of the cavity, the injection and/or reception surface having at least a width or a length or a diameter greater than λ, where λ is the wavelength of the working frequency, and the distribution of the power of the electromagnetic waves over the injection and/or reception surface having a point where the power is maximum, that point being remote from the periphery of the surface, and the power decreasing continuously along a straight line running from that point to the periphery, irrespective of the direction of the straight line considered in the plane of that surface, wherein the excitation device comprises at least one flared electromagnetic waveguide (32; 52, 54; 70; 86; 94; 100) equipped with a distal end, which opens inside the resonant cavity, and a proximal end capable of being connected to an electromagnetic wave generator and/or receiver (30), the surface area of the transverse cross-section of the distal end being strictly greater than the surface area of the transverse cross-section of the proximal end, and in which the distal end of the waveguide is flush with the lower wall in order to form said injection and/or reception surface.

2. Antenna according to claim 1, in which the flared guide (32; 52, 54; 70; 86; 94; 100) comprises a feed guide (34; 72; 78; 88), the transverse cross-section of which is constant and equal to the cross-section of the proximal end, and a flared portion (36; 74; 80; 90; 104), the transverse cross-section of which increases from a small cross-section identical with the transverse cross-section of the proximal end to a large cross-section identical with the transverse cross-section of the distal end, the small cross-section of the flared portion being placed end-to-end with the feed guide, and in which the dimensions of the transverse cross-section of the feed guide are suitable for permitting only one electromagnetic wave propagation mode inside the feed guide.

3. Antenna according to claim 2, wherein the dimensions of the transverse cross-section of the feed guide (34; 72; 78; 88) are suitable for permitting only propagation mode TE10 or TE11.

4. Antenna according to claim 3, in which the shortest distance separating the small cross-section from the large cross-section of the flared portion (36; 74; 80; 90; 104) is greater than $d_{min}$, where $d_{min}$=0.25*a; and a is equal to the largest width or length or diameter of the large cross-section.

5. Antenna according to claim 2, in which the shortest distance separating the small cross-section from the large cross-section of the flared portion (36; 74; 80; 90; 104) is greater than $d_{min}$, where $d_{min}$=0.25*a; and a is equal to the largest width or length or diameter of the large cross-section.

6. Antenna according to claim 1, in which the injection and/or reception surface is strictly less than the surface area of the radiating outer face (20).

7. Antenna according to claim 1, in which the lower wall of the cavity and the injection and/or reception surface are in the same plane.

8. Antenna according to claim 1, in which the antenna comprises a plurality of excitation devices (52, 54) each having an electromagnetic wave injection and/or reception surface flush with the lower wall of the cavity.

9. Method of transmitting or receiving electromagnetic waves, wherein the method comprises the transmission or reception of electromagnetic waves with the aid of an antenna according to claim 1.

10. Antenna according to claim 1, in which the injection and/or reception surface is strictly less than the surface area of the radiating outer face (20) and less than twice the surface area of the radiating outer face.

11. System for transmitting and/or receiving electromagnetic waves, which system comprises:

a device (62) for focusing the electromagnetic waves transmitted and/or received by the system, the device having a focus (64), and a multi-bundle antenna (66) having an outer face that is radiant in transmission or in reception and is located substantially at the level of the focus of the focusing device, wherein, the multi-bundle antenna is an antenna using PBG (photonic band gap) material, comprising:

a first PBG material (4) having at least one-dimensional periodicity and an outer face (20) that is radiant in transmission and/or in reception, at least one first periodicity defect of the PBG material forming a first resonant cavity (8) capable of creating at least one narrow pass-band within a stop band of the PBG material, the cavity having an upper wall formed by a lower face of the PBG material opposite the radiant outer face, and a lower wall facing the upper wall, a plurality of excitation devices (10; 70; 86; 94; 100; 112; 132; 152) capable of making the resonant cavity resonate, the devices having a surface (26; 122) for injecting and/or receiving electromagnetic waves at a working frequency contained within the narrow pass-band, the surface being flush with the lower wall of the cavity, each injection and/or reception surface has at least a width or a length or a diameter greater than $\lambda$, where $\lambda$ is the wavelength of the working frequency of the corresponding excitation device, and each excitation device comprises at least one flared electromagnetic waveguide (32; 52, 54; 70; 86; 94; 100) equipped with i) a distal end opening inside the resonant cavity, and ii) a proximal end arranged to be connected to an electromagnetic wave generator and/or receiver (30), the surface area of the transverse cross-section of the distal end being strictly greater than the surface area of the transverse cross-section of the proximal end, and wherein the distal end of the waveguide is flush with the lower wall in order to from said injection and/or reception surface.

* * * * *